US005609118A

United States Patent [19]

Hodges et al.

[11] Patent Number: 5,609,118

[45] Date of Patent: Mar. 11, 1997

[54] HOSIERY LINE CLOSER AND LOADER ASSEMBLY

[75] Inventors: Michael J. Hodges, High Wycombe; Darren Horton, Kirkby-in-Ashfielld, both of England

[73] Assignee: Detexomat Machinery Limited, High Wycombe, England

[21] Appl. No.: 385,908

[22] Filed: Feb. 9, 1995

[30] Foreign Application Priority Data

Feb. 11, 1994 [GB] United Kingdom ..... 9402684

[51] Int. Cl.[6] ..... D05B 33/00; D05B 21/00

[52] U.S. Cl. ..... 112/470.15; 112/475.12

[58] Field of Search ..... 112/470.08, 470.15, 112/475.12

[56] References Cited

U.S. PATENT DOCUMENTS

| | | | |
|---|---|---|---|
| Re. 30,410 | 10/1980 | Povlacs . | |
| Re. 32,481 | 8/1987 | Hodges . | |
| 2,722,348 | 11/1955 | Ammon . | |
| 2,898,021 | 8/1959 | Miles et al. . | |
| 2,948,240 | 8/1960 | Burd et al. . | |
| 3,353,726 | 11/1967 | Kronsbein . | |
| 3,355,074 | 11/1967 | Brewin et al. . | |
| 3,672,313 | 6/1972 | Firestein et al. . | |
| 3,696,942 | 10/1972 | Kitchener et al. . | |
| 3,704,565 | 12/1972 | Glaze, Jr. . | |
| 3,793,968 | 2/1974 | Beazely . | |
| 3,799,086 | 3/1974 | Block . | |
| 3,941,069 | 3/1976 | Fukuyama . | |
| 4,166,556 | 9/1979 | Annas, Sr. . | |
| 4,308,980 | 1/1982 | Gazzarrini . | |
| 4,364,320 | 12/1982 | Nakhle et al. . | |
| 4,440,329 | 4/1984 | Hodges . | |
| 4,538,534 | 9/1985 | Frazier et al. . | |
| 4,539,924 | 9/1985 | Bell, Jr. et al. . | |
| 4,550,868 | 11/1985 | Hodges et al. . | |
| 4,598,817 | 7/1986 | Bell, Jr. et al. . | |
| 4,602,710 | 7/1986 | Bell, Jr. et al. . | |
| 4,620,494 | 11/1986 | Takatori et al. . | |
| 4,643,340 | 2/1987 | Bailey . | |
| 4,649,838 | 3/1987 | Gazzarrini . | |
| 4,784,070 | 11/1988 | Thurner et al. . | |
| 5,040,475 | 8/1991 | Fournier et al. . | |
| 5,058,516 | 10/1991 | Maegawa et al. | 112/470.15 X |
| 5,129,337 | 7/1992 | Humphreys | 112/470.15 |
| 5,165,355 | 11/1992 | Fournier et al. . | |
| 5,207,166 | 5/1993 | Eichorn | 112/475.12 |
| 5,402,733 | 4/1995 | Humphreys | 112/470.15 |

FOREIGN PATENT DOCUMENTS 2081316 2/1982 United Kingdom .

*Primary Examiner*—Paul C. Lewis
*Attorney, Agent, or Firm*—Dority & Manning, P.A.

[57] ABSTRACT

A hosiery line closer and loader assembly comprises a line closer having a number of carriers which circulate on a carousel and a loader having a transfer mechanism by which hose can be transferred from a hose loading position, adjacent a human operator, for example, to the line closer, the transfer mechanism moving on a linear support. Also disclosed is a dual hosiery line closer and loader assembly in which two line closers can be alternately loaded from a single hose loading position.

22 Claims, 2 Drawing Sheets

HOSIERY LINE CLOSER AND LOADER ASSEMBLY

This invention relates to hosiery line closers. More particularly, the invention relates to a line closer having a plurality of carriers mounted on a rotatable carousel for carrying pairs of tubular hose to be joined which carriers can be circulated around a path so as to pass in turn a hose mounting station, hose positioning and hose joining stations and a hose dismounting station.

Line closer machines are well known and their operation will not be described in detail in this application. In general terms, however, a pair of hose is loaded onto a carrier at the loading station after which the rotation of the carousel circulates the carrier round the hose positioning and hose joining stations, the processed article being removed from the carrier at the demounting station. The carrier is then able to accept a new pair of hose once it has circulated once again to the loading station. An example of such apparatus is the line closer model LC-320 of the Japanese firm Takatori Machinery Works.

Such line closers are generally loaded by a human operator who holds the open welt ends of the hose between his or her fingers and pushes them onto the carrier. This can be a difficult manual operation with some line closers as well as requiring the operator to stand close to the machine.

This is particularly problematical with 5-station line closers which are more compact than a 6 or 7-station line closer.

Nowadays line closers are being fitted with automatic hose positioners which accurately position the hose before joining on the carriers, thus relieving the human operator from this task. A single positioner aligns the welts of the hose on the carrier, a double positioner also aligns the lower edge of the body portion of the hose on the carrier.

Single and especially double positioners reduce the time window in which the carrier can be loaded by the operator. This means in certain circumstances the carousel has to be temporarily halted to provide more loading time, or it must rotate more slowly to make operating the machine for any length of time more feasible.

UK Patent Application GB-A-2,231,483 describes a loader for loading a line closer machine. It comprises a rotatable carousel having a number of equi-angularly spaced, radially extending transfer arms each of which carries pairs of support fingers for holding two hose at their open welt ends. The carousel rotates about a vertical axis moving each arm through a hose loading position and to one or two line closer machines. The human operator loads pairs of hose on the transfer arm at the hose loading station from where they are carried to the line closer for transfer to a carrier on the line closer.

There are disadvantages associated with such a line closer and loader assembly. The human operator is still located relatively close to the line closer and the orientation relative to the human operator of the support fingers changes as the transfer arm rotates past the loading station. The former disadvantage is exacerbated if the loader is used to load a pair of line closers as the operator will then be located between and close to two line closers. The latter mentioned disadvantage makes loading time critical which reduces operator flexibility and increases operator fatigue due to the need for concentration on loading during a specific time interval as the moving arm circulates past. Further, the loader is bulky and has to be rigidly locked to the operation of the two line closers in order to keep all three machines synchronised.

The present invention seeks to provide an improved hosiery line closer and loader assembly. Accordingly, there is provided a hosiery line closer and loader assembly comprising:

a liner closer having a plurality of carriers mounted on a rotatable carousel for carrying pairs of tubular hose having welt ends to be joined wherein the carriers can be circulated around a path so as to pass in turn a hose mounting station, hose positioning and hose joining stations, and a hose dismounting station; and a loader having a transfer mechanism including a loading frame arranged to be able to hold two hose by their welt ends and an elongated support extending between a hose loading position, where the loading frame can be loaded with two hose, and the line closer, wherein the transfer mechanism is configured to move along a path defined by the elongated support, which path is linear at least through the hose loading position, and wherein the transfer mechanism is arranged to co-operate with the line closer and a carrier thereof to transfer the two hose to the carrier at the hose mounting station.

The carousel may be rotated continuously or indexed. The loading frame could be loaded by a human operator or a mechanical pick and place unit. The transfer frame may be arranged to be stationary at the loading position but a continuously moving loading frame could be used in the present invention.

The loading frame preferably comprises two pairs of support fingers, for example tubular, each pair being movable apart to grip one of the hose after loading of the pair of hose on the support fingers.

The transfer mechanism can be arranged to move the loading frame directly away from the loading position after it has been loaded with hose either before, or as part of, the movement of the transfer mechanism towards the line closer. This provides a positive removal of the loading frame and hose away from a human operator or pick and place unit with potentially safer operation of the assembly in the former case.

Movement of the transfer mechanism on loading may be initiated by a detector, such as a photocell or switch, which is positioned to be triggered by the hose when in a suitable position to be taken from the operator by the loading frame.

In order to provide more accurate alignment of the loading frame with a carrier of the line closer, it may be preferable that the transfer mechanism halts temporarily at an intermediate position while moving from the hose loading position to the line closer, some 5 to 10 cms from the position a carrier occupies at or near the transfer position, for example. The movement to the line closer is continued once a carrier is at or approaching the transfer position. This can provide more accurate synchronisation of the loading mechanism with a carrier for the transfer process.

A further way of enhancing the synchronisation of the transfer mechanism with a carrier is to provide that the linear support is pivotable about the vertical axis of rotation of the carousel of the line closer, the linear support being arranged to be pivoted during transfer of the hose from the loading frame to a carrier so as to maintain radial alignment of the loading frame and the carrier.

The pivoting can be achieved by either rotating the support in the opposite sense to the rotation of the carousel after loading the loading frame with hose and rotating the support with the carousel during the transfer of the hose to a carrier or else by again pivoting it with the carousel during transfer of the hose to a carrier but in the opposite sense to the rotation of the carousel after transferring the hose to the carrier as the transfer mechanism moves back to the leading position to bring it back into position for loading the loading frame with hose.

A particularly convenient way of providing the synchronous rotation of line closer carousel and support is to provide co-operating, releasable engagement means mounted on the carousel and the support. For example, a latch could be pushed upwards from the carousel to engage the support during transfer of the hose. The support can be rotated in the opposite direction to the carousel of the line closer by, for example, a hydraulic piston and cylinder mechanism.

A particularly useful arrangement of the loading mechanism is one in which the loading frame is arranged to be loaded by movement of the hose in a direction sideways to the general direction of movement of the transfer frame towards or away from the line closer, for example at right angles to the axis of the linear support. This allows two line closer assemblies to be located side by side and to be loaded alternately by one operator or pick and place unit, the transfer frame of one moving to the left whilst the other is arranged to move to the right towards the respective line closers. An advantage of this arrangement over that of the prior art rotary loader is that each line closer and loader assembly operates independently of the other. When pivotable linear supports are used with two line closers having carousels rotating in the same sense it will be necessary to employ one loader in which the support rotates away from the loading position after loading and one which the support moves away from the loading position during transfer of the hose to a carrier, as will be explained in more detail with reference to the illustrated embodiment of the invention.

The loading frame may be arranged to rise vertically after transfer of the hose to a carrier to provide clearance of the loading frame from the carrier so it can return to the operator or pick and place unit for loading. It will have to be lowered before transferring a next set of hose to another carrier. This may be carried out before or after loading the next set of hose. In the former case it is preferably carried out before the transfer frame arrives back at the hose loading position so when there is a human operator he or she can anticipate the arrival of the loading frame so making loading quicker and easier.

An embodiment of the present invention will now be described, by way of example only, with reference to the accompanying drawings of which:

Figure 1:
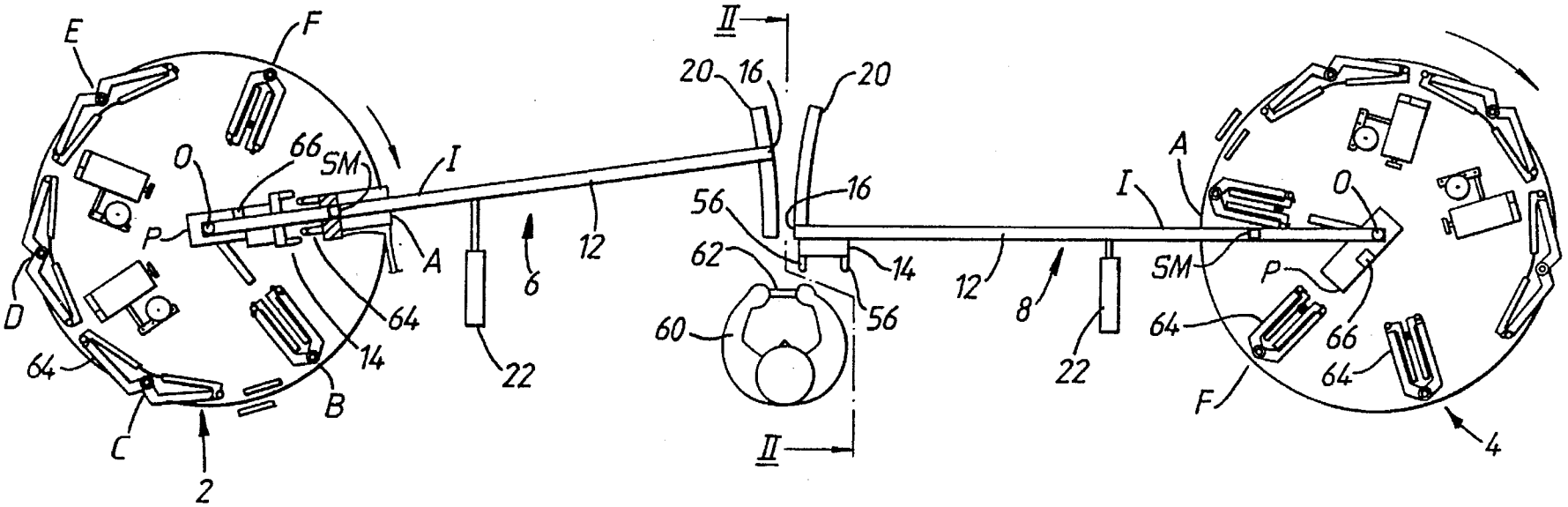
FIG. 1 is a schematic plan view of a dual arrangement of two line closer and loader assemblies each according to the present invention.

Referring to FIG. 1, there is shown a pair of identical line closer machines 2, 4, each associated with a respective loader and each forming a line closer and loader assembly according to the present invention. The same reference numerals are used in relation to the common features of the two assemblies.

The line closers 2, 4 and their operation can be as described in detail in U.S. Pat. No. 5,207,166, the disclosures of which patent are here imported into the present application by reference. The invention is not, however, restricted to this particular type or arrangement of line closer which may include a line closer having a number of stations other than the six of the illustrated 6-station line closer, for example it could be a 5- or 7-station line closer.

Each line, has, in this exemplary embodiment, six carriers 64. Each carrier 10 circulates around the line closer passing in turn a hose mounting station A, hose positioning and hose joining stations C to E, and a hose dismounting station F (see line closer 2). A pair of hose mounted on a carrier (as shown at station A of line closer 2) is processed at the line closer stations in known manner.

Each loader 6, 8 has a linear support 12 along which a transfer mechanism 14 can move between a hose loading position at a first end 16 of the support 12 distant from the associated line closer 2, 4. Each support 12 is a rodless cylinder.

Figure 2:
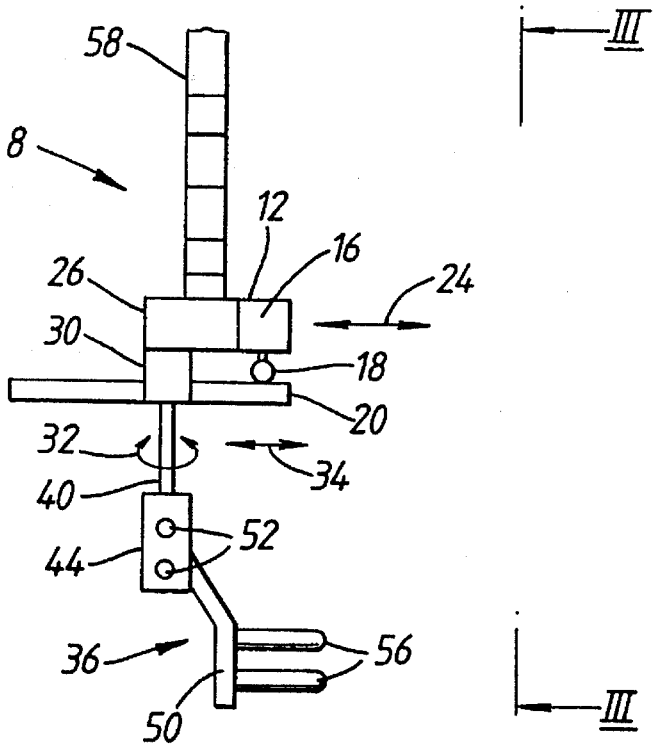
FIG. 2 is a schematic end view of the one loader of FIG. 1 along the direction II—II of FIG. 1.
Figure 3:
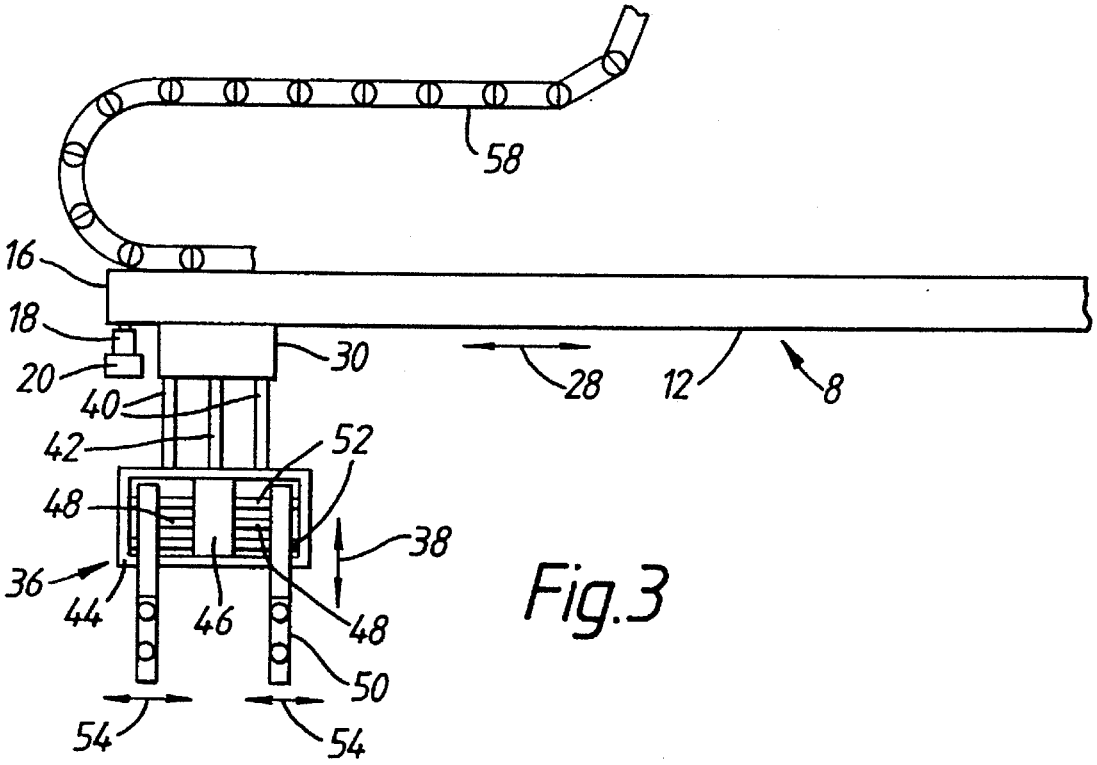
FIG. 3 is a schematic side view of the loader of FIGS. 1 and 2 along the direction III—III of FIG. 2.

Referring to FIGS. 2 and 3, briefly, the underside of the support 12 has at end 16 a wheel 18 which runs on a horizontally disposed arcuate track plate 20. The other end of the support 12 is pivotally mounted on a vertical axis 0 at the centre of rotation of the carousel of the respective line closer 2, 4. The support 12 can be rotated in the horizontal plane by operation of pneumatic cylinder 22 with the end 16 of the support 12 moving forwards and backwards along the track plate 20. This movement is indicated by double-headed arrow 24 in FIG. 2.

In FIGS. 2 and 3 there are shown, in a simplified representation, the principal components of the transfer mechanism 14.

A first housing 26 is mounted on the support 12 for movement along the support 12 between the hose loading position and the line closer as described above in connection with FIG. 1 and as indicated by the double-headed arrow 28 in FIG. 3.

Mounted underneath the first housing 26 is a second housing 30 in such a way that pneumatic controllers (not shown) in the first housing 26 can both rotate the second housing 30 through 90° about a vertical axis in the sense indicated by the arrow 32 from the position shown and back again, and translate the second housing 30 in a horizontal direction as indicated by the double-headed arrow 34.

Depending from the second housing 30 is a loading frame 36 housed such that pneumatic controllers (not shown) in the second housing 30 can move the loading frame vertically up and down as indicated by the double-headed arrow 38 of FIG. 3 on guide tubes 40 by a piston rod 42 extending from the second housing 30.

The loading frame 36 comprises a support frame 44 in which is mounted a pneumatic controller 46 from which extend, in opposite directions, piston rods 48 the ends of which are attached to a respective hose support 50 mounted on a pair of horizontal parallel rails 52 mounted in the support frame 44. The hose supports 50 can be moved towards and away from each other, horizontally, by the pneumatic controller 46 as indicated by double-headed arrows 54 in FIG. 3.

Each hose support 50 comprises a plate with vertical end sections and an angled intermediate section. The hose support 50 is supported on the guide rails 52 which pass through through-holes in the upper end of the vertical end sections. The lower end section of the support 50 supports a pair of tubular hose support fingers 56 (see FIG. 2) which extend horizontally from the hose support 50, one vertically displaced above the other. The fingers 56 are aligned horizontally with the fingers 56 on the other hose support of the frame 36.

Control signals and pneumatic power are fed to the transfer mechanism 14 via an articulated support 58. Pneumatic controllers suitable for providing the relative movement of the elements of the transfer mechanism 14 and of the transfer mechanism 14 on the support 12 are well known and will not be described in any detail.

The various air supplies and electrical control connections have been omitted from the simplified figures for clarity, as has the articulated support 58 from FIG. 1.

The operation of the embodiment of FIGS. 1 to 3 will now be described with reference in the first instance to the loader 8 and line closer 4 of the Figures.

The loader 8 is shown at what may conveniently be regarded as the start of a loading cycle. In this embodiment the loader is loaded by a human operator 60 but loading could be effected by a pick and place unit at the loading position. The operator 60 has two hose 62 in his or her hands with the welts opened and directed towards the loading frame 14. The operator's fingers of both hands (not shown) are inserted into the hose welts holding them open with the openings stretched horizontally.

The two hose are positioned on the loading frame 36 with the two horizontally spaced fingers 56 of the loading frame 36 inside the opening of each hose 62. The operator then lets go of the hose which contract onto the fingers 56. The hose supports 50 are then moved apart by the pneumatic controller 46 so the fingers 56 stretch and further grip the hose 62. The pneumatic controller (not shown) in the first housing 26 then pulls the second housing 30 away from the operator 60. The transfer mechanism 14 is then positioned as shown in FIGS. 2 and 3.

The pneumatic controller of the second housing 30 then simultaneously lowers the loading frame 36 and rotates it through 90° so the fingers 56 of the loading frame 36 point directly away from the line closer 4.

The transfer mechanism 14 is then moved along the support 12 to an intermediate position I (see FIG. 1) with the base of the fingers 56 some 5 to 10 cms from the line closer carrier position when at the loading station A. By the time the transfer mechanism 14 is at the intermediate position I an empty carrier 64 from the demounting station F will be at or close to the loading station A.

As the carrier 64 approaches the loading station A a latch 66 is extended vertically upwards from the carousel of the line closer 4 so as to be engagable with the support 12. Once so engaged the support 12 pivots about the vertical axis 0 with the transfer mechanism 14 in radial alignment with the carrier 64, the wheel 18 supporting the end 16 of the rod 12 running along the support track 20.

As the support 12 rotates, the transfer mechanism is moved lengthwise along the carrier 64, with the carrier 64 extending into the two hose 62.

A signal means SM is arranged to output a pulsed signal when the loading frame 36 has moved along the carrier 64 a predetermined distance. The carrier arms are arranged to clamp the hose in response to receipt of the signal so the hose is clamped for the duration of the pulse. The clamping of the hose by the carrier 64 and the continued motion of the loading frame 36 ensures disengagement of the hose from the fingers 56. The carrier arms then open to allow a double positioner P to operate. Alternatively, the welts could be pulled from the fingers 56 by a suitably positioned stop.

A carrier arranged as just described to clamp the hose for the duration of a signal pulse could be used with a line closer operated in conjunction with a transfer mechanism other than the one moving along a linear support according to the present invention. This arrangement is of more general applicability to line closers than the specific use described above in relation to a line closer and loader of the present invention.

The loading frame 36 is lifted upwards after the hose has been removed from the fingers 56 and rotated by 90° to the loading orientation by the pneumatic controller (not shown) of the housing 30 and the hose supports 50 are moved back towards each other by the pneumatic controller 46.

The latch 66 is lowered to disengage it from the support 12 which is now moved back to its position at the start of the cycle by pneumatic cylinder 22. The transfer mechanism is simultaneously moved back to the loading position for the start of the next loading cycle as shown in FIG. 1.

The operation of the loader 6 of FIG. 1 is the same as that described in relation to loader 8 except for the phasing of the movement of the support 12 about the pivot axis 0 in relation to the movement of the transfer mechanism on line closer 2. In this case the support arm 12 is pivoted away from the operator 60 by the pneumatic cylinder 22 once the hose has been loaded onto the loading frame 36 and the transfer mechanism is about to move towards the line closer 2. The latch 66 engages the support as before to maintain radial alignment of the carrier 64 and the transfer mechanism 14 but now the support 12 is rotated back to the position required for reloading the hose supports 50 with another pair of hose as the transfer mechanism 14 is returned to the loading position by the operator 60. The synchronisation of the movements of the carrier 64 and the transfer mechanism 14 in the frame of reference of the support 12 is the same in each case.

It will be noted that the line closers 2 and 4 are arranged so that loading of a carrier takes place alternately, first on one line closer then the other. The operator can therefore load hose onto the respective transfer mechanisms 14 as they return to the loading position by the operator.

If one line closer and loader assembly is to be used on its own, the transfer mechanism 14 can be simplified as rotation of the loading frame 36 is no longer necessary. In this case the operator or pick and place unit faces the line closer 4 with the finger 56 of the loading frame 36 also pointing directly away from the line closer 4.

In the foregoing description, the line closer(s) and loader assemblies have been described along with their operation. The operation discloses a general method of loading one or two line closers, and the present invention comprehends such method within its scope.

We claim:

1. A hosiery line closer and loader assembly comprising:

a line closer having a plurality of carriers mounted on a rotatable carousel for carrying pairs of tubular hose, having welt ends, to be joined, wherein the carriers can be circulated around a path so as to pass in turn a hose mounting station, hose positioning and hose joining stations, and a hose dismounting station; and a loader having a transfer mechanism including a loading frame arranged to be able to hold two hose by their welt ends and an elongated linear support extending between a hose loading position, where the loading frame can be loaded with two hose, and the line closer, wherein the transfer mechanism is configured to move along the elongated support from the hose loading position to the line closer so that the transfer mechanism follows a linear path at least through the hose loading position, and wherein the transfer mechanism is arranged to co-operate with the line closer and a carrier thereof to transfer the two hose to the carrier at the hose mounting station.

2. An assembly as claimed in claim 1 and including a positioner for aligning the welts of the hose on the carrier.

3. An assembly as claimed in claim 2 in which the positioner is a double positioner for also aligning lower edges of body portions of the hose on the carrier.

4. An assembly as claimed in claim 1 in which the line closer is a 5 to 7-station line closer.

5. An assembly as claimed in claim 1 in which the loading frame includes two pairs of support fingers and wherein the loading frame is configured to move the support fingers of each pair apart after loading of the pair of hose on the support fingers.

6. An assembly as claimed in claim 1 in which the loading frame is configured to move directly away from the loading position after loading the hose on the loading frame before, or as part of, the movement of the transfer mechanism to the line closer.

7. An assembly as claimed in claim 1 in which the transfer mechanism is timed to arrive at the line closer in synchronization with a carrier to which the hose is to be transferred.

8. An assembly as claimed in claim 1 in which, after transfer of the hose to the carrier, the loading frame moves upwardly and is returned to the loading position.

9. An assembly as claimed in claim 1 in which the elongated support is pivotable about the vertical axis of rotation of the carousel of the line closer, the elongated support being arranged to pivot during transfer of the hose from the loading frame to a carrier so as to maintain radial alignment of the loading frame and the carrier.

10. An assembly as claimed in claim 9 in which the elongated support is pivotable in an opposite sense to the rotation of the carousel after loading the loading frame with hose and before transferring the hose to the carrier.

11. An assembly as claimed in claim 9 in which the elongated support is pivotable in an opposite sense to the rotation of the carousel after transferring the hose to the carrier and before loading the loading frame with hose.

12. An assembly as claimed in claim 9 in which the elongated support is pivoted by means of a cooperating, releasable engagement means mounted on the carousel.

13. An assembly as claimed in claim 1 in which the loading frame is adapted to be loaded by movement of the hose in a direction sideways to the general direction of movement of the frame towards or away from the line closer.

14. An assembly as in claim 13, having a pair of line closer and loader assemblies, each of the assemblies including a said line closer and an associated said loader, wherein the loading positions of the assemblies are adjacent and the loading frames of the assemblies are adjacent and wherein the loading frames of the assemblies are configured to be loaded in the same general direction.

15. An assembly as claimed in claim 14 in which the elongated supports of the assemblies are configured to move the transfer mechanisms such that the loading frames can be loaded with hose alternately.

16. An assembly as claimed in claim 1 in which the transfer mechanism is arranged to be stationary at the hose loading position.

17. An assembly as claimed in claim 1 in which the carrier is configured to clamp the hose when the transfer mechanism has moved along the carrier a predetermined distance so as to remove the hose from the moving transfer mechanism.

18. An assembly as claimed in claim 17 in which the carrier is configured to clamp the hose upon receipt of a signal, and including a signal means arranged to output the signal as a pulse of a predetermined duration when the transfer mechanism has moved along the carrier the predetermined distance, the carrier clamping the hose for the duration of the pulse.

19. A method of loading hose blanks on a line closer, which utilizes a transfer mechanism with a loading frame movable along a path between the line closer and a loading station disposed at a distance to one side of the line closer, comprising the steps of:

presenting two hose blanks to the loading frame by a movement in a direction non-coincident with the path, effecting a rotary movement of the loading frame into a predetermined attitude relative to the path for subsequent transfer to the line closer and a movement along the path, initiating, adjacent the line closer, an arcuate movement of the loading frame, at least partially concave with respect to the line closer, which maintains a radial alignment of the loading frame with a hose carrier of the line closer, establishing a relative movement of the loading frame to the carrier for placing the hose blanks thereon and for stripping them from the loading frame, and thereafter returning the loading frame to the loading station.

20. A method according to claim 19, wherein said steps are effected with respect to two line closers, wherein each line closer is associated with a respective transfer mechanism and loading frame, wherein both transfer mechanisms are loaded at the loading station, and wherein the transfer mechanisms and their respective line closers are phased in their operations so that said steps are alternately effected with respect to the two line closers and their associated transfer mechanisms.

21. A hosiery line closer and loader assembly comprising:

a line closer having a plurality of carriers mounted on a rotatable carousel for carrying pairs of tubular hose, having welt ends, to be joined, the carriers being moveable around a path so as to pass in turn a hose mounting station, hose positioning and hose joining stations, and a hose dismounting station; and a loader having a transfer mechanism including a loading frame arranged to hold two hose by their welt ends, the loader configured to convey the loading frame between a hose loading position, where the loading frame can be loaded with two hose, and the line closer, the transfer mechanism configured to co-operate with the line closer and a carrier thereof to transfer the two hose to the carrier, the loader further configured to move the loading frame arcuately, at least partially concave with respect to the line closer, to maintain radial alignment of the loading frame and the carrier during transfer of the two hose to the carrier.

22. A method of loading hose blanks on a line closer including a rotatable carousel, which utilizes a transfer mechanism with a loading frame moveable between the line closer and a loading station disposed at a distance to one side of the line closer, comprising the steps of:

presenting two hose blanks to the loading frame;

moving the loading frame toward the line closer proximate a hose carrier of the line closer that moves with the carousel;

moving the loading frame for a predetermined distance along an arcuate path that is at least partially concave with respect to the line closer to maintain radial alignment with the carrier, for transfer of the hose from the loading frame to the carrier; and transferring the two hose blanks to the carrier.

* * * * *